United States Patent [19]

Higuchi et al.

[11] Patent Number: 4,784,731

[45] Date of Patent: Nov. 15, 1988

[54] CHROMATE TREATMENT OF A METAL COATED STEEL SHEET

[75] Inventors: Seijun Higuchi; Akinori Maruta; Kenichi Asakawa, all of Fukuoka; Akimitsu Fukuda; Haruyoshi Terada, both of Tokyo; Youji Ono, Tokyo, all of Japan

[73] Assignee: Nippon Steel Corporation, Tokyo, Japan

[21] Appl. No.: 49,502

[22] Filed: May 12, 1987

[30] Foreign Application Priority Data

May 12, 1986 [JP] Japan ..... 61-107897
May 24, 1986 [JP] Japan ..... 61-118393

[51] Int. Cl.[4] ..... C25D 5/00

[52] U.S. Cl. ..... 204/27; 204/56.1; 204/38.4; 204/42

[58] Field of Search ..... 204/27, 37.6, 56.1, 204/70, 41, 42, 38.4

[56] References Cited

U.S. PATENT DOCUMENTS 4,519,879 5/1985 Ichida et al. ..... 204/56.1
4,545,871 10/1985 Krijl et al. ..... 204/56.1

*Primary Examiner*—R. L. Andrews
*Attorney, Agent, or Firm*—Wenderoth, Lind & Ponack

[57] ABSTRACT

A chromate treatment of metal coated steel sheets comprising subjecting the sheets to a cathodic electrolytic treatment to form a chromate film thereon and subjecting the sheet to an anodic electrolytic treatment to form an anodic electrolytic film on the chromate film and to convert the chromate film. The treatment is applicable to various metal coated steel sheets, such as those coated with zinc, zinc alloy, aluminum, aluminum alloy, lead and lead alloy, and is effective to improve the corrosion resistance of the sheets, the quality of paint coating applied on the sheets and the adaptability of the sheets to a cation electro-deposition paint coating.

9 Claims, 1 Drawing Sheet

CHROMATE TREATMENT OF A METAL COATED STEEL SHEET

BACKGROUND OF THE INVENTION

1. Field of the Invention

The present invention relates to chromate treatment of surface treated steel sheets and strips (herein called steel sheets), which chromate treatment comprises forming a complex chromate film or layer composed of a cathodic electrolytic film and an anodic electrolytic film, excellent in corrosion resistance, paintability and, in particular, adaptability to cation electro-deposition paint coating, on the surface of galvanized or zinc alloy coated steel sheets, aluminium or aluminium alloy coated steel sheets and lead or lead alloy coated steel sheets.

2. Description of the Related Art

As for the electrolytic chromate treatment of galvanized steel sheets, it is known to perform a cathodic treatment in a treatment solution of $CrO_3$—$H_2SO_4$, as disclosed in Japanese Patent Publication Sho No. 47-44417, and to perform a cathodic treatment in a treatment solution of $CrO_3$-$SiO_2$ as disclosed in Japanese Laid-Open Patent Application Sho No. 60-110896. As for similar treatments for steel sheets coated with Zn, Al and Sn and their alloys, a cathodic electrolytic treatment in a treatment solution composed of $CrO_3$, various metal ions, and fluorine or chlorine is disclosed in Japanese Patent Publication Sho No. 49-14457 and so on. All of these prior methods form a chromate film on metal or alloy coated steel sheets by a cathodic treatment. Generally speaking, the cathodic electrolytic film is insufficient in corrosion resistance despite its good paintability. Therefore, in order to compensate for the insufficient corrosion resistance of the conventional cathodic electrolytic chromate film, trials have been made to form an increased amount of film (specifically to increase the amount of chromium deposition). However, the chromate film, when applied in a greater amount, will be colored, thus damaging the surface appearance of the coated steel sheets, and will degrade the paintability of the sheets. Therefore, it has hitherto been difficult to form a film excellent in all of the surface appearance, corrosion resistance, and paintability. Moreover, when galvanized steel sheets or the like are continuously treated by the prior art cathodic electrolytic treatment, $Zn^{2+}$ ions will accumulate in the treating solution to cause problems such that the corrosion resistance of the coated steel sheets is markedly lowered.

Referring to the anodic electrolytic treatment, it is also possible to form a chromate film on metal or alloy coated steel sheets by an anodic electrolytic treatment, but the resultant film is very poor in corrosion resistance and paintability. Further, in the case of galvanized steel sheets in particular, disadvantages of the anodic electrolytic treatment are that the metal of the steel sheets being treated will dissolve into the treating solution according to Faraday's law, thus causing inconsistency in the solution, and prohibiting of a consistent commercial operation.

SUMMARY OF THE INVENTION

Therefore, the object of the present invention is to solve the problems of the prior art treatments and to provide a process which can consistently form on the surface of galvanized or zinc alloy coated steel sheets, aluminum or aluminium alloy coated steel sheets, and lead or lead alloy coated steel sheets, a chromate film which is excellent in various properties, particularly film uniformity, corrosion resistance, and adaptability to a cation electro-deposition paint coating.

In order to solve the problems of the prior art treatments, the present inventors conducted extensive various studies and investigations and found that remarkable technical advantages can be obtained when the coated steel sheets are subjected to a complex chromate treatment in a chromate treatment bath containing cations as illustrated below, in which a chromate film is formed on the sheets and then immediately an anodic electrolytic film is formed by an anodic electrolytic treatment in the same bath to modify the previously formed cathodic electrolytic film.

According to the present invention, a chromate film containing metal ions is formed by the cathodic electrolytic treatment and then immediately the chromate film is converted into a hardly soluble film by the anodic electrolytic treatment, resulting in a complex chromate film containing metal cations.

As the result, remarkable improvements in the corrosion resistance, and the paint coating qualities of the coated steel sheets can be obtained. Particularly the adaptability to paint coating is markedly improved by the effect of metals contained in the chromate film which cause the chromate film to function as an anode better than a conventional chromate film during the cation electro-deposition paint coating.

BRIEF DESCRIPTION OF THE ACCOMPANYING DRAWING

The accompanying drawing shows the relation between the corrosion resistance and the $Zn^{2+}$ ion concentration in the treating solution.

DETAILED DESCRIPTION OF THE INVENTION

Figure 1:
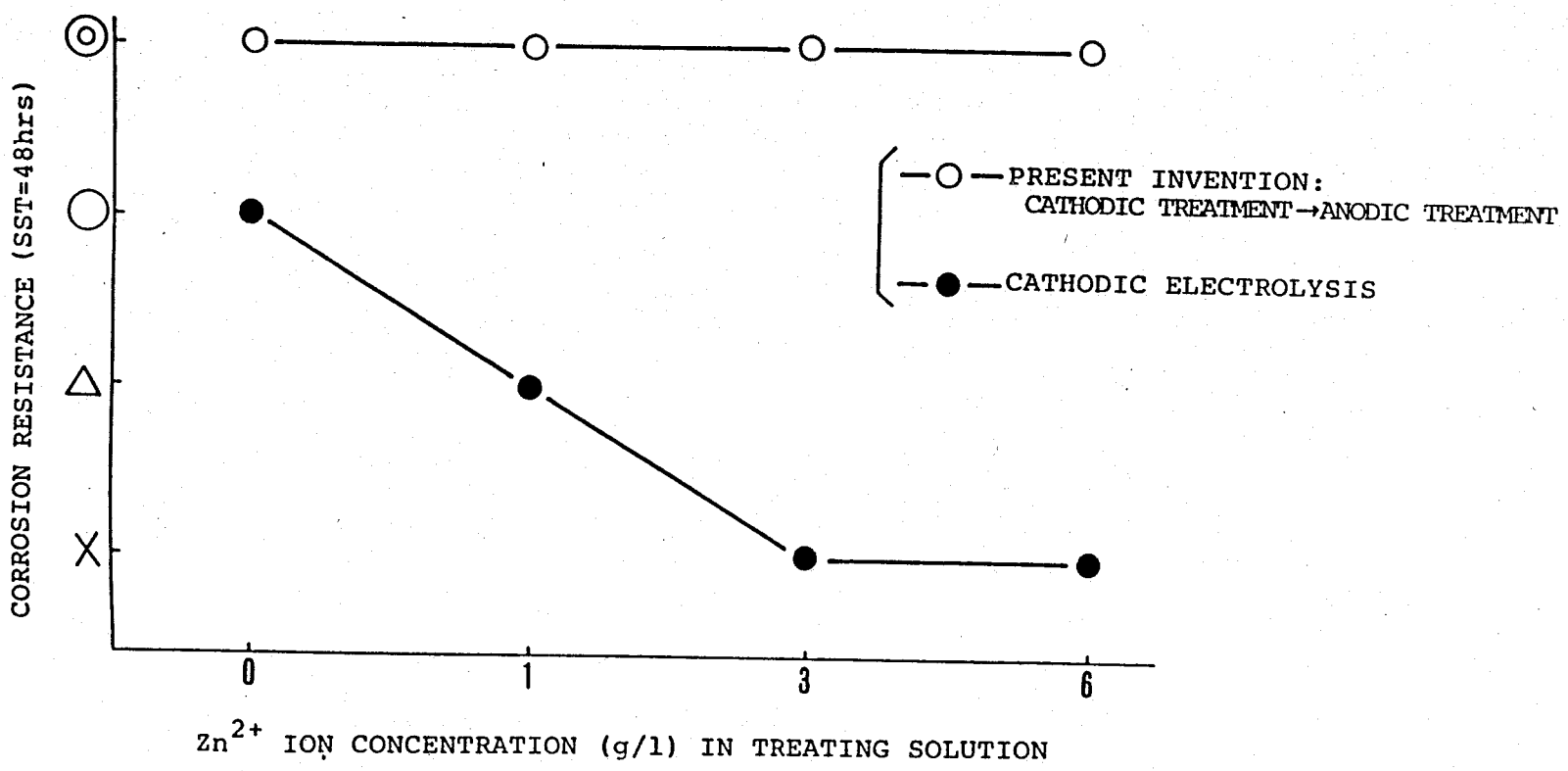

In the present invention, the cathodic electrolytic treatment is performed by using a metal coated steel sheet as a cathode to form a chromate film containing metal ions on the surface of the metal coated steel sheets, and the amount of the chromate film (chromium deposition amount) is controlled by selecting the current density and electrolysis time. The current density and electrolysis time are not specifically limited in the present invention, but it is desirable for better results to control the amount of the chromate film with a current density ranging from 3 to 50 $A/dm^2$ by selecting the electrolysis time.

The anodic treatment which follows the cathodic treatment is performed by using the cathodically treated sheet on which the cathodic electrolytic film has been formed as an anode, to form thereon an anodic film and also to convert the cathodic film. It is preferable to perform the anodic treatment with a current density ranging from 1 to 50 $A/dm^2$, more preferably from 5 to 40 $A/dm^2$, and a coulomb value ranging from 0.1 to 30, more preferably from 2 to 20 $C/dm^2$.

When the current density is less than 1 $A/dm^2$, the desired cathodic film is hardly obtained and the resultant corrosion resistance is not satisfactory. On the other hand when the density is larger than 50 $A/dm^2$, no substantial improvement can be obtained.

When the amount of electricity is less than 0.1 $C/dm^2$, the conversion effect on the film quality is lowered due to the smaller amount of film formed, and in excess of 30 C/dm$^2$, the improvement effect on the film quality will become saturated. Further, with the increased amount of electricity in excess of 30 C/dm$^2$, a larger amount of the metal will be coated on the steel sheets; Zn in the case of galvanized steel sheets, dissolves into the bath, thus hindering the desired consistency of the bath composition. Therefore, 30 C/dm$^2$ is an upper limit for a commercial operation.

The chromate treating bath used in the present invention may have the following bath compositions.

(1) A chromate bath containing $Cr^{6+}$ ions, $PO_4^{3-}$ ions and/or a fluorine compound, and one or more members selected from the group consisting of Zn ions, Ni ions, Co ions, Al ions, Mg ions, Sn ions, Mn ions and Pb ions.

(2) A chromate bath containing $Cr^{6+}$ ions, silica and/or silicate, and one or more members selected from the group consisting of Zn ions, Ni ions, Co ions, Al ions, Mg ions, Sn ions, Mn ions, and Pb ions.

(3) A chromate bath containing $Cr^{6+}$ ions, $PO_4^{3-}$ ions and/or a fluorine compound, silica and/or silicate, and one or more members selected from the group consisting of Zn ions, Ni ions, Co ions, Al ions, Mg ions, Sn ions, Mn ions and Pb ions.

The cathodic electrolysis and the anodic electrolysis may be done in the same chromate bath or the cathodic electrolysis and the anodic electrolysis may be separately done in different baths.

As for the $Cr^{6+}$ ions contained in the bath, any of chromic acid, bichromic acid, and their alkali metal salts and ammonium salts may be used singly or in combination as desired, and it is preferable that the range of the $Cr^{6+}$ ions concentration is from 5 to 70 g/l, more preferably from 7.5 to 50 g/l.

When the $Cr^{6+}$ ion concentration is less than 5 g/l, the improvement effect on the corrosion resistance by the treatment of the present invention is not tangible, while when the concentration is in excess of 70 g/l, the effect will become saturated and such problems are caused that the amount of the chromate bath taken out with the steel sheets being treated increases and the working environment is worsened by fumes and mists generated from the bath.

As for $PO_4^{3-}$ ions, phosphoric acid, alkali metal salts of phosphoric acid and ammonium phosphate may be used, and as the fluorine compound, any of hydrofluoric acid, hydrofluosilicic acid, borofluoric acid, hydrofluoric titanic acid, and their salts may be used singly or in combination. When the $PO_4^{3-}$ ions and the fluorine compound are contained in the solution in an amount of 1 to 100 g/l in total, more desirable results can be obtained. When the amount of these components is less than 1 g/l, the chromate bath can have only a very low electric conductivity and the solubility of the metal ions into the bath becomes too low so that the desired improvement effect on the chromate film may often not be obtained.

On the other hand, when the amount of the components is more than 100 g/l, the resultant chromate film suffers irregularities in the surface appearance, possibly due to the fact that the chromate film, in some cases, is partially dissolved before the film is washed or dried.

The silica and/or silicate are added for the purpose of forming a colloidal silica in the bath, and any one or more of anion types of colloidal silica, cation types of colloidal silica and silicates of alkaline metals can be used for this purpose. A preferable concentration of these silicas and silicates, as expressed in terms of $SiO_2$, is from 1 to 100 g/l.

With the $SiO_2$ concentrations less than 1 g/l, the improvement effects on the corrosion resistance and paintability as desired by the present invention are not substantial. On the other hand, with the $SiO_2$ concentration more than 100 g g/l, the improvement effects will become saturated and also the electric conductivity of the chromate bath decreases so that the amount of electricity required for forming the desired amount of chromate film is inevitably increased.

The metal ions may be added in any form of metal powder, chromates, phosphates, fluorides, carbonates, hydroxides and so on. A better result can be obtained when the metal ions are present in the bath in an amount ranging from 0.5 to 50 g/l. With the metal ions in an amount less than 0.5 g/l, it cannot be assured that the metal ions are introduced into the chromate film during the formation of the film by the cathodic electrolytic treatment to improve the corrosion resistance and to afford the chromate film the desired electric conductivity which enhances the anodic functions during the cation electro-deposition paint coating process. On the other hand, when the concentration exceeds 50 g/l, the desired effects will become saturated and the resultant chromate film has a poor workability which leads to deterioration of the corrosion resistance at worked portions.

Regarding the pH value of the bath, it should be not higher than 6, preferably not higher than 4. When the pH value is higher than 6, there is a large tendency that precipitates and floating matters are very often produced in the bath and these precipitates and floating matters cause arcspots on the steel materials being treated during the electrolytic treatment, resulting in undesirable deterioration of the corrosion resistance and surface appearance.

For controlling the pH value of the bath, any of sulphates, ammonium hydroxides, hydroxides of alkaline metals and carbonates of alkaline metals may be added to the bath. Further, as for the source of the $Cr^{3+}$ ions which are generated by the reduction reaction during the cathodic electrolytic treatment according to the present invention, hydroxides such as $Cr(OH)_3$ and carbonates may be added to the bath. Alternately the bath component, $CrO_3$, may be reduced by addition of organic compounds such as alcohols, starches, tannic acids to generate $Cr^{3+}$.

The treating bath is normally maintained in a temperature range from ordinary temperatures to 70° C. The bath temperature may be raised higher than 70° C. without causing changes in the film quality, but it is uneconomical. Therefore the upper limit for the bath temperature from the economical point for a commercial operation is 70° C.

The metal coated steel sheet treated by the electrolytic treatments (cathodic and anodic treatment) according to present invention is washed and dried for final use as an anti-corrosive material or as a substrate for paint coating. The treated sheet may be passed through squeezing rolls without washing, and dried for final use. Further if necessary, the treated sheet may be subjected to after-treatments as commonly performed with the chromate solution and anti-corrosive water-soluble organic compounds.

The metal coated steel sheets applicable to the present invention may be prepared by electrolytic plating, hot-dip coating, vacuum deposition coating and so on, and includes the following metal coated sheets, for example.

(1) The galvanic or Zn coated steel sheets and zinc-alloy coated steel sheets: specifically sheets coated with zinc and sheets coated with zinc alloy containing not more than 0.5% aluminium. The zinc coating or zinc-aluminium alloy coating may further contain small amounts of impurities such as Sb, Pb and Cd. The zinc coating may contain 3 to 60% aluminium and one or more of Si, Mg, and misch metals in an amount of not more than 2%, or may contain one or both of Ni and Co in an amount ranging from 5 to 25%, with or without addition of one or both of $SiO_2$ and Cr in an amount not more than 10%. Further the zinc alloy coating may be Zn-Fe alloy coating containing 8 to 90% Fe.

(2) Aluminium coated steel sheets and aluminium alloy coated steel sheets: The aluminium coating may contain unavoidable impurities, and the aluminium alloy coating may contain unavoidable impurities, may contain 1 to 15% Si and unavoidable impurities, or may contain 1 to 15% Si and not more than 3% Mg.

(3) Lead coating steel sheets and lead-alloy coated sheets: the lead coating may contain unavoidable impurities, and the lead alloy coating may contain 1 to 30% Sn, with or without one or more of Sb, Zn and Cd in an amount not more than 5%, and unavoidable impurities.

As mentioned hereinbefore, the chromate film formed by a cathodic electrolysis will be colored when the film amount is increased for the purpose of obtaining an improved corrosion resistance, thus deteriorating the surface appearance of resultant sheets and lowering the qualities of paint coating applied thereon. Also in the case of zinc coated steel sheets, a continuous chromate treatment of such sheets will cause accumulation of $Zn^{2+}$ ions in the treating solution, which leads a markedly lowered corrosion resistance of the resultant sheets.

According to the present invention, as shown in Table 1, the corrosion resistance can be greatly improved without suffering from deterioration of the surface appearance by the anodic electrolytic treatment following the cathodic treatment.

Further according to the present invention, as shown in FIG. 1 for example, a satisfactory corrosion resistance can be assured by virtue of the anodic treatment despite the possible accumulation of $Zn^{2+}$ ions in the treating solution during the chromate treatment of zinc coated steel sheets, and the above problems of the cathodic treatment can be well overcome, and a film excellent in surface appearance, corrosion resistance and qualities of paint coating applied thereon can be consistently formed in commercial operations. Also the present invention is effective for eliminating the problems caused by the transfer and accumulation into the bath of the coating metals from coated materials as encountered in conventional surface treatments as mentioned hereinbefore.

In the present invention, a preferable range of the chromate film in terms of the content of Cr in the film is from 5 to 300 mg/m$^2$, more preferably from 10 to 100 mg/m$^2$.

DETAILED DESCRIPTION OF THE PREFERRED EMBODIMENTS

The present invention will be better understood from the following description of preferred embodiments in comparison with similar steel sheets not treated according to the present invention.

Steel strips were subjected to conventional pre-treatments for metal coating and then subjected to chromate treatments as shown in Table 1. After the chromate treatments, the strips were washed, roll squeezed, and heated and dried at an ambient temperature of 150° C. for 5 seconds. Evaluation results of various properties of the chromate treated materials are shown in Table 2 in comparison with similar materials not treated according to the present invention. For the comparison, the same surface treated steel sheets as shown in the table were subjected to the chromate treatments according to the present invention and to the comparative treatments outside the present invention, and the properties obtained by these treatments were compared.

Evaluation tests and evaluation criteria are as set forth below.

(1) Corrosion Resistance

Test samples were subjected to salt spray testings according to JIS Z-2371, and the rust formation (white rust and black pots due to partial dissolution of the coating layer) after a specific time was observed and evaluated according to the following criteria.

◎ : less than 1% rust formation

○: more than 1% up to 5% rust formation

Δ: more than 5% up to 15% rust formation

×: more than 15% rust formation.

(2) Quality of Paint Coating

Commercially available melamine alkyd white paint was applied in an amount of 25μ on the test samples treated as shown in Table 1 and the qualities of the paint coatings were evaluated.

a. Check Pattern Erichsen Test

A check pattern comprising one hundred squares of 1 mm was scratched on the paint coatings applied on the test samples and then the samples were drawn 7 mm by an Erichsen testing machine and subjected to the peel-off tests using a vinyl tape to observe visually and evaluate the peel-off of the coatings a four-grade evaluation as shown in Table 2.

b. Dupon Impact Test

A weight of 500 g was dropped from 50 cm height onto the paint coated test samples using a Dupon impact testing machine to impact on the paint coatings. The peeling-off of the coatings was visually judged with eyes and evaluated for a four-grade evaluation as shown in Table 2.

c. Corrosion Resistance after Paint Coating

Scratches were made through the paint coatings to the surface of the metal coatings of the test samples, and the corrosion resistance was evaluated by observing the width of the swelling of the coatings after 240 hours of salt spray. Evaluations was made as below.

◎ : not more than 2 mm of average swelling width from the scratched portion

○: more than 2 mm to 4 mm of average swelling width

Δ: more than 4 mm to 7 mm of the average swelling width

×: more than 7 mm of average swelling width.

(3) Quality of Cation Electro-Deposition Paint coating

The test pieces treated as shown in Table 1 were applied with paint coatings by electro-deposition at 200 V for 3 minutes.

a. Amount of Coating

The amounts of coating on the sheets surface-treated but not chromate-treated and the amounts of coating on the sheets both surface-treated and chromate-treated were measured to evaluate the paintability. The evaluation was made with the coating amount on the sheet without chromate treatment being scored as 1.

◎: 0.95 or more

○: less than 0.95 to 0.85

Δ: less than 0.85 to 0.70

×: less than 0.75.

b. Corrosion Resistance after Cation Electro-Deposition Paint Coating

After the cation electro-coating, the coatings were baked at 180° C. for 20 minutes, and scratched to the surface of the metal coating, subjected to 240 hours salt spray, followed by a vinyl tape peeling-off test to evaluate the corrosion resistance on the basis of the peeling-off width of the coating.

◎ : very little peeling-off of the coating from the scratched portion and other portions; the corrosion resistance is very good ○ : relatively large peeling-off of the coating from the scratched portion, but very little from other portions, and the corrosion resistance is relatively good Δ: considerably large peeling-off of the coating from the scratched portion and other portions and the corrosion resistance is inferior ×: very large peeling-off of the coating from the scratched portion and other portions; and the corrosion resistance is very poor.

TABLE 1

| | Surface Treatments | Treating Bath Compositions | Treating Conditions | Cr Coating Amount |
|---|---|---|---|---|
| Example 1-1 | Electro Zn coated steel sheet (30 g/m$^2$) | Chromic acid 30 g/l ($Cr^{6+}$ 15.2 g/l) - Phosphoric acid 20 g/l ($Po_4^{3-}$ 19.3 g/l) - Ni 3 g/l (introduced by addtion of nickel carbonate); pH: 1.2 | Cathodic electrolysis (30 A/dm$^2$ - 2 sec.) followed by anodic electrolysis (15 A/dm$^2$ - 0.3 sec.), then water washing | 158.6 mg/m$^2$ |
| Example 1-2 | Electro Zn - 13% Ni alloy coated steel sheet (20 g/m$^2$) | Same as Example 1-1 | Same as Example 1-1 | 147.5 mg/m$^2$ |
| Comparison 1-1 | Same as Example 1-1 | Same as Example 1-1 | Cathodic electrolysis (30 A/dm$^2$ - 2 sec.) followed by water washing | 38.1 mg/m$^2$ |
| Comparison 1-2 | Same as Example 1-2 | Same as Example 1-1 | Same as Comparison 1-1 | 32.4 mg/m$^2$ |
| Example 2-1 | Vacuum deposition Zn coated steel sheet (40 g/m$^2$) | Chromic acid 50 g/l ($Cr^{6+}$ 26.0 g/l) - Snow Tex 0 ® (60 g/l, produced by Nissan Kagaku K. K., colloidal solution containing 20% $SiO_2$) - Sodium silicofluoride 2 g/l - Hydrofluoric acid 0.6 g/l - Mn 5 g/l (introduced by addtion of manganese phosphate); pH: 0.7 | Cathodic electrolysis (15 A/dm$^2$ - 4 sec.) followed by anodic electrolysis (5 A/dm$^2$ - 0.2 sec.), then water washing | 102.3 mg/m$^2$ |
| Example 2-2 | Electro Zn - 15% Fe alloy coated steel sheet (25 g/m$^2$) | Same as Example 2-1 | Same as Example 2-1 | 96.4 mg/m$^2$ |
| Example 2-3 | Hot-dip Zn - 6% Al - 0.1% Mg alloy coated steel sheet (45 g/m$^2$) | Same as Example 2-1 | Same as Example 2-1 | 92.7 mg/m$^2$ |
| Comparison 2-1 | Same as Example 2-1 | Same as Example 2-1 | Cathodic electrolysis (15 A/dm$^2$ - 4 sec.) followed by water washing | 28.3 mg/m$^2$ |
| Comparison 2-2 | Same as Example 2-2 | Same as Example 2-1 | Same as Comparison 2-1 | 25.7 mg/m$^2$ |
| Comparison 2-3 | Same as Example 2-3 | Same as Example 2-1 | Same as Comparison 2-1 | 23.3 mg/m$^2$ |
| Example 3-1 | Hot-dip Zn - 0.1% Al alloy coated steel sheet (60 g/m$^2$) | Chromic acid 15 g/l ($Cr^{6+}$ 7.8 g/l) - Phosphoric acid 10 g/l - Borofluoric acid 15 g/l - Zn 5 g/l - Co 2.5 g/l (the metal ions were introduced by addtion of their carbonates); pH: 2.2 | Cathodic electrolysis (20 A/dm$^2$ - 1.5 sec.) followed by anodic electrolysis (20 A/dm$^2$ - 0.5 sec. ), then roll squeezing | 167.5 mg/m$^2$ |
| Example 3-2 | Electro Pb coated steel sheet (45 g/m$^2$) | Same as Example 3-1 | Same as Example 3-1 | 44.2 mg/m$^2$ |
| Example 3-3 | Hot-dip Pb - 8% Sn alloy coated steel sheet (48 g/m$^2$) | Same as Example 3-1 | Same as Example 3-1 | 48.9 mg/m$^2$ |
| Comparison 3-1 | Same as Example 3-1 | Same as Example 3-1 | Cathodic electrolysis (20 A/dm$^2$ - 1.5 sec.) followed by water washing | 32.3 mg/m$^2$ |
| Comparison 3-2 | Same as Example 3-2 | Same as Example 3-1 | Same as Comparison 3-1 | 12.6 mg/m$^2$ |
| Comparison 3-3 | Same as Example 3-3 | Same as Example 3-1 | Same as Comparison 3-1 | 11.8 mg/m$^2$ |
| Example 4-1 | Electro Zn - 12% Ni - 2% $SiO_2$ alloy coated steel sheet (20 g/m$^2$) | Ammonium bichromate 100 g/l ($Cr^{6+}$ 41.5 g/l) - 30% Hydrofluoric acid 30 g/l - Al 1 g/l c-Sn 1.5 g/l - Pb 0.5 g/l (the metal ions were introduced by addtion of their powdered oxides); pH: 1.6 | Cathodic electrolysis (40 A/dm$^2$ - 1 sec.) followed by anodic electrolysis (40 A/dm$^2$ - 0.2 sec.), then water washing | 155.6 mg/m$^2$ |
| Example 4-2 | Vacuum deposition Al coated steel sheet (30 g/m$^2$) | Same as Example 4-1 | Same as Example 4-1 | 108.3 mg/m$^2$ |
| Example 4-3 | Hot-dip Al - 9% Si alloy coated steel sheet (33 g/m$^2$) | Same as Example 4-1 | Same as Example 4-1 | 111.1 mg/m$^2$ |
| Comparison 4-1 | Same as Example 4-1 | Same as Example 4-1 | Cathodic electrolysis (40 A/dm$^2$- 1 sec.) followed by water washing | 24.6 mg/m$^2$ |
| Comparison 4-2 | Same as Example 4-2 | Same as Example 4-1 | Same as Comparison 4-1 | 18.7 mg/m$^2$ |
| Comparison 4-3 | Same as Example 4-3 | Same as Example 4-1 | Same as Comparison 4-1 | 16.5 mg/m$^2$ |

TABLE 1-continued

| | Surface Treatments | Treating Bath Compositions | Treating Conditions | Cr Coating Amount |
|---|---|---|---|---|
| Example 5-1 | Electro Zn coated steel sheet (40 g/m$^2$) | Chromic acid 10 g/l ($Cr^{6+}$ 5.2 g/l) - Colloidal silica 10 g/l - 20% Hydrofluoric acid 16 g/l - Co 1 g/l- Mg 1.5 g/l (the metal ions were introduced by addtion of their carbonates); pH: 0.8 | Cathodic electrolysis (50 A/dm$^2$- 0.5 sec.) followed by anodic electrolysis (30 A/dm$^2$ - 0.1 sec.), then water washing | 182.8 mg/m$^2$ |
| Example 5-2 | Electro Zn - 11% Ni alloy coated steel sheet (20 g/m$^2$) | Same as Example 5-1 | Same as Example 5-1 | 147.1 mg/m$^2$ |
| Comparison 5-1 | Same as Example 5-1 | Same as Example 5-1 | Cathodic electrolysis (50 A/dm$^2$ - 0.5 sec.) followed by water washing | 32.1 mg/m$^2$ |
| Comparison 5-2 | Same as Example 5-2 | Same as Examale 5-1 | Same as Comparison 5-1 | 20.5 mg/m$^2$ |
| Comparison 5-3 | Same as Example 5-2 | Same as Exmple 5-1 | Immersion (2 sec.) followed by water washing, then roll squeezing | 31.6 mg/m$^2$ |
| Example 6-1 | Hot-dip Zn - 50% Al - 1.2% Si alloy coated steel sheet (50 g/m$^2$) | Chromic acid 20 g/l ($Cr^{6+}$ 10.4 g/l) - 40% Hydrofluosilicic acide 16 g/l - Phosphoric acid 30 g/l - 20% Borofluoric acid 16 g/l - Co 20 g/l (the metal ions was introduced by addtion of their carbonate); pH: 1.3 | Cathodic electrolysis (60 A/dm$^2$ - 1 sec.) followed by anodic electrolysis (15 A/dm$^2$ - 0.8 sec.), then water washing | 187.6 mg/m$^2$ |
| Example 6-2 | Hot-dip Zn - 10% Fe alloy coated steel sheet (45 g/m$^2$) | Same as Example 6-1 | Same as Example 6-1 | 165.3 mg/m$^2$ |
| Comparisona 6-1 | Same as Example 6-1 | Same as Example 6-1 | Cathodic electrolysis (60 A/dm$^2$ - 1 sec.) followed by water washing | 15.5 mg/m$^2$ |
| Comparison 6-2 | Same as Example 6-2 | Same as Example 6-1 | Same as Comparison 6-1 | 19.4 mg/m$^2$ |
| Example 7-1 | Electro Zn coated steel sheet (20 g/m$^2$) | Chromic acid 60 g/l ($Cr^{6+}$ 31.2 g/l) - Colloidal silica 90 g/l - Zn 0.5 g/l - Mg 0.5 g/l (the metal ions were introduced by addtion of their carbonates); pH: 1.5 | Cathodic electrolysis (25 A/dm$^2$ - 4 sec.) followed by anodic electrolysis (20 A/dm$^2$ - 0.3 sec.), then water washing | 134.6 mg/m$^2$ |
| Example 7-2 | Hot-dip Zn - 0.15% Al - 0.2% Sb alloy coated steel sheet (60 g/m$^2$) | Same as Example 7-1 | Same as Example 7-1 | 118.5 mg/m$^2$ |
| Comparison 7-1 | Same as Example 7-1 | Same as Example 7-1 | Cathodic electrolysis (25 A/dm$^2$ - 4 sec.) followed by water washing | 21.5 mg/m$^2$ |
| Comparison 7-2 | Same as Example 7-2 | Same as Example 7-1 | Same as Comparison 7-1 | 18.3 mg/m$^2$ |
| Comparison 8-1 | Electro Zn coated steel sheet (20 g/m$^2$) | Chromic acid 15 g/l ($Cr^{6+}$ 7.8 g/l) - Silica gel ($SiO_2$ 20 g/l: 20% $SiO_2$ colloidal solution 100 g/l); pH: 0.8 | Cathodic electrolysis (15 A/dm$^2$ - 4 sec.) followed by anodic electrolysis (15 A/dm$^2$ - 0.2 sec.), then water washing | 25.2 mg/m$^2$ |
| Comparison 8-2 | Electro Zn - 12% Ni alloy coated steel sheet | Chromic acid 30 g/l ($Cr^{6+}$ 15.6 g/l) - Phosphoric acid 10 g/l - 20% Borofluoric acid 15 g/l; pH: 1.4 | Cathodic electrolysis (30 A/dm$^2$ - 1.6 sec.) followed by water washing | 10.4 mg/m$^2$ |
| Comparison 8-3 | Electro Zn coated steel sheet (30 g/m$^2$) | Same as Example 1, but containing no metal ions | Cathodic electrolysis followed by roll squeezing | 147.3 mg/m$^2$ |
| Comparison 8-4 | Hot-dip Zn - 6% Al - 0.1% Mg alloy coated steel sheet | Same as Example 2, but containing no metal ions | Immersion (3 sec.) followed by roll squeezing | 185.3 mg/m$^2$ |

TABLE 2

| | (1) Corrosive Resistance | | (2) Quality of Paint Coating | | | (3) Cation electro-Deposition Coating | |
|---|---|---|---|---|---|---|---|
| | a. SST 72 hrs | b. SST 120 hrs | Check Pattern Erichsen Test | b. Impact Test | Corrosion Resistance after Paint Coating | a. Paint Adhesion | b. Corrosion Resistance after Paint Coating |
| Example 1-1 | ◎ | ○ | ○ | ○ | ◎ | ◎ | ◎ |
| Example 1-2 | ◎ | ◎ | ○ | ○ | ◎ | ◎ | ◎ |
| Comparison 1-1 | Δ | X | ◎ | ◎ | Δ | ◎ | Δ |
| Comparison 1-2 | Δ | Δ | ◎ | ◎ | Δ | ◎ | Δ |
| Example 2-1 | ◎ | ○ | ◎~○ | ◎~○ | ◎ | ◎ | ◎ |
| Example 2-2 | ◎ | ○ | ◎~○ | ◎ | ◎ | ◎ | ◎ |
| Example 2-3 | ◎ | ◎~○ | ◎~○ | ◎~○ | ◎ | ◎ | ◎ |
| Comparison 2-1 | Δ | X | ◎ | ◎ | Δ | ◎ | Δ |
| Comparison 2-2 | X | X | ◎ | ◎ | X | ◎ | X |
| Comparison 2-3 | Δ | Δ | ◎~○ | ◎~○ | Δ | ◎ | Δ |
| Example 3-1 | ◎ | ◎ | ○ | ○ | ◎ | ◎ | ◎ |
| Example 3-2 | ◎ | ◎ | ◎~○ | ◎ | ◎ | ◎ | ◎ |
| Example 3-3 | ◎ | ◎ | ◎~○ | ◎ | ◎ | ◎ | ◎ |
| Comparison 3-1 | X | X | ○ | ◎~○ | X | ◎ | Δ |
| Comparison 3-2 | ○ | X | 0 | 0 | X | ◎ | X |
| Comparison 3-3 | ○ | X | Δ | Δ | X | ◎ | X |
| Example 4-1 | ◎ | ◎ | ○ | ○ | ◎ | ◎ | ◎ |
| Example 4-2 | ◎ | ◎ | ○ | ○ | ◎ | ◎ | ◎ |

TABLE 2-continued

| | (1) Corrosive Resistance | | (2) Quality of Paint Coating | | | (3) Cation electro-Deposition Coating | |
|---|---|---|---|---|---|---|---|
| | a. SST 72 hrs | b. SST 120 hrs | Check°Pattern Erichsen Test | b. Impact Test | Corrosion Resistance after Paint Coating | a. Paint Adhesion | b. Corrosion Resistance after Paint Coating |
| Example 4-3 | ○ | ○ | ○ | ○ | ◎ | ◎ | ◎ |
| Comparison 4-1 | ○ | Δ | ○ | ○ | Δ | X | X |
| Comparison 4-2 | ○ | Δ | ○ | ○~Δ | X | X | ◎ |
| Comparison 4-3 | ◎ | Δ | ○ | ○~Δ | Δ | X | X |
| Example 5-1 | ◎ | ◎ | ○ | ○ | ◎ | ◎ | ◎ |
| Example 5-2 | ○ | ◎ | ○ | ○ | ◎ | ◎ | ◎ |
| Comparison 5-1 | Δ | X | ◎ | ◎ | Δ | ◎ | X |
| Comparison 5-2 | ○ | Δ | ◎ | ◎ | Δ | ◎ | Δ |
| Comparison 5-3 | ◎ | Δ | ◎ | ◎ | Δ | ◎ | Δ |
| Example 6-1 | ◎ | ◎ | ○ | ○ | ◎ | ◎ | ◎ |
| Example 6-2 | ○ | ○ | ○ | ○ | ◎ | ◎ | ◎ |
| Comparison 6-1 | ○ | X | Δ | Δ | X | ◎ | X |
| Comparison 6-2 | X | X | Δ | Δ | X | ◎ | X |
| Example 7-1 | ◎ | ◎ | ○ | ○ | ◎ | ◎ | ◎ |
| Example 7-2 | ◎ | ◎ | ○ | ◎ | ◎ | ◎ | ◎ |
| Comparison 7-1 | Δ | X | ○ | ◎ | X | ◎ | X |
| Comparison 7-2 | X | X | ◎ | ○ | X | ◎ | X |
| Comparison 8-1 | ◎ | Δ | ◎ | ○ | Δ | Δ | X |
| Comparison 8-2 | Δ | X | X | Δ | ◎ | ◎ | Δ~X |
| Comparison 8-3 | ◎ | ◎ | X | X | ◎ | X | X |
| Comparison 8-4 | ◎ | ◎ | X | X | X | X | X |

What is claimed is:

1. A method for treating a metal coated steel sheet, comprising:

subjecting a metal coated steel sheet to a cathodic electrolytic treatment, to form a cathodically electrolytic chromate film thereon, in a bath of a composition containing (1) $Cr^{6+}$ ions, (2) ions of at least one element selected from the group consisting of Zn, Ni, Co, Al, Mg, Sn, Mn and Pb, and (3) at least one additive selected from the group consisting of $PO_4^{3-}$ ions, a fluorine compound, silica and a silicate, and immediately subjecting the resultant steel sheet to an anodic electrolytic treatment in a bath of said composition to convert said cathodically electrolytic chromate film and further to form an anodically electrolytic chromate film thereon.

2. A method according to claim 1, wherein said additive comprises $PO_4^{3-}$ ions, at least one fluorine compound, or both $PO_4^{3-}$ ions and at least one fluorine compound.

3. A method according to claim 1, wherein said additive comprises at least one of silica and a silicate.

4. A method according to claim 1, wherein said additive comprises components (a) and (b) wherein component (a) is $PO_4^{3-}$ ions, at least one fluorine compound, or both $PO_4^{3-}$ ions and at least one fluorine compound, and component (b) is at least one of silica and a silicate.

5. A method according to any one of claims 1 to 4, wherein said metal coated steel sheet is a zinc coated steel sheet, zinc alloy coated steel sheet, aluminum coated steel sheet, aluminium alloy coated steel sheet, lead coated steel sheet or lead alloy coated steel sheet.

6. A method according to any one of claims 1 to 4, wherein said cathodic electrolytic treatment and said anodic electrolytic treatment are performed in the same chromate treatment bath.

7. A method according to any one of claims 1 to 4, wherein said cathodic electrolytic treatment and said anodic electrolytic treatment are performed in different chromate treatment baths.

8. A chromate treatment according to claim 5, wherein said cathodic electrolytic treatment and said anodic electrolytic treatment are performed in the same chromate treatment bath.

9. A chromate treatment according to claim 5, wherein said cathodic electrolytic treatment and said anodic electrolytic treatment are performed in different chromate treatment baths.

* * * * *